US011168432B2

(12) United States Patent
Lee et al.

(10) Patent No.: US 11,168,432 B2
(45) Date of Patent: Nov. 9, 2021

(54) LAUNDRY TREATMENT APPARATUS

(71) Applicant: LG ELECTRONICS INC., Seoul (KR)

(72) Inventors: Jihong Lee, Seoul (KR); Kwangchul Heo, Seoul (KR)

(73) Assignee: LG Electronics Inc., Seoul (KR)

( * ) Notice: Subject to any disclaimer, the term of this patent is extended or adjusted under 35 U.S.C. 154(b) by 234 days.

(21) Appl. No.: 16/191,703

(22) Filed: Nov. 15, 2018

(65) Prior Publication Data

US 2019/0085498 A1 Mar. 21, 2019

Related U.S. Application Data

(62) Division of application No. 15/281,455, filed on Sep. 30, 2016, now Pat. No. 10,604,883, which is a (Continued)

(30) Foreign Application Priority Data

May 30, 2014 (KR) ..... 10-2014-0065885
May 19, 2015 (KR) ..... 10-2015-0069663

(51) Int. Cl.
*D06F 39/08* (2006.01)
*D06F 29/00* (2006.01)
(Continued)

(52) U.S. Cl.
CPC ..... *D06F 39/088* (2013.01); *D06F 23/02* (2013.01); *D06F 29/00* (2013.01); *D06F 29/005* (2013.01);
(Continued)

(58) Field of Classification Search
CPC ..... D06F 39/088; D06F 29/00; D06F 29/005; D06F 39/08; D06F 37/12; D06F 39/12
See application file for complete search history.

(56) References Cited

U.S. PATENT DOCUMENTS 427,331 A 5/1890 Knaus
6,125,881 A 10/2000 Hobbs et al.
(Continued)

FOREIGN PATENT DOCUMENTS

CN 101161912 4/2008
CN 101407990 4/2009
(Continued)

OTHER PUBLICATIONS

Indian Office Action in Indian Application No. 604/KOL/2015, dated Nov. 1, 2018, 6 pages.
(Continued)

*Primary Examiner* — Irina Graf
(74) *Attorney, Agent, or Firm* — Fish & Richardson P.C.

(57) ABSTRACT

A laundry treatment apparatus includes a cabinet and a drawer retractably provided in the cabinet. An accommodation unit is provided at the drawer and defines a space configured to receive washing water. The laundry treatment apparatus includes a guider. The guider includes a first body rotatably coupled to the cabinet, and a second body rotatably coupled to the first body and the drawer and configured to connect the first body to the drawer. A supply unit is connected to a water supply source. A water supply channel is provided along the guider and is configured to supply water between the supply unit and the accommodation unit.

16 Claims, 11 Drawing Sheets

Related U.S. Application Data division of application No. 14/726,374, filed on May 29, 2015, now Pat. No. 9,945,064.

(51) Int. Cl.

| | |
|---|---|
| ***D06F 39/12*** | (2006.01) |
| ***D06F 23/02*** | (2006.01) |
| ***D06F 31/00*** | (2006.01) |
| ***D06F 37/12*** | (2006.01) |

(52) U.S. Cl.

CPC ..... *D06F 31/00* (2013.01); *D06F 37/12* (2013.01); *D06F 39/08* (2013.01); *D06F 39/12* (2013.01); *D06F 39/125* (2013.01)

(56) References Cited

U.S. PATENT DOCUMENTS

| | | | |
|---|---|---|---|
| 7,603,792 | B1 | 10/2009 | McDonald et al. |
| 7,850,784 | B2 | 12/2010 | Gunnerson et al. |
| 8,056,374 | B2 | 11/2011 | Hoppe |
| 9,217,218 | B2 | 12/2015 | Kim et al. |
| 9,670,609 | B2 | 6/2017 | Lee et al. |
| 9,945,064 | B2 | 4/2018 | Lee et al. |
| 10,458,056 | B2 | 10/2019 | Lee et al. |
| 2006/0130535 | A1 | 6/2006 | Sunshine et al. |
| 2009/0139276 | A1 | 6/2009 | Kim |
| 2009/0288452 | A1 | 11/2009 | Lee |
| 2010/0101282 | A1 | 4/2010 | Jeong et al. |
| 2010/0107704 | A1 | 5/2010 | Seo |
| 2011/0012485 | A1 | 1/2011 | Buesing et al. |
| 2011/0265524 | A1 | 11/2011 | Kim |
| 2012/0096901 | A1 | 4/2012 | Zattin et al. |
| 2012/0255329 | A1 | 10/2012 | Wanweerakul |
| 2014/0060121 | A1 | 3/2014 | Burger |
| 2015/0345062 | A1 | 12/2015 | Lee et al. |

FOREIGN PATENT DOCUMENTS

| | | |
|---|---|---|
| CN | 101578409 | 11/2009 |
| CN | 101725015 | 6/2010 |
| CN | 102292494 | 12/2011 |
| CN | 202509291 | 10/2012 |
| CN | 102844486 | 12/2012 |
| DE | 112011101522 | 5/2013 |
| EP | 1911870 | 4/2008 |
| JP | H01-092966 | 6/1989 |
| JP | H04-187132 | 7/1992 |
| JP | 2001-046308 | 2/2001 |
| JP | 2001314695 | 11/2001 |
| JP | 2002291677 | 10/2002 |
| JP | 2012143483 | 8/2012 |
| KR | 2011057920 | 6/2011 |
| WO | 2009142354 | 11/2009 |
| WO | 2012150539 | 11/2012 |

OTHER PUBLICATIONS

United States Office Action in U.S. Appl. No. 16/019,860, dated Apr. 24, 2020, 19 pages.

Chinese Office Action in Chinese Application No. 201610692700.0, dated Jan. 2, 2018, 15 pages (with English translation).

Chinese Office Action in Chinese Application No. 201610693456.x, dated Jan. 2, 2018, 14 pages (with English translation).

United States Notice of Allowance in U.S. Appl. No. 14/726,374, dated Dec. 7, 2017, 9 pages.

United States Office Action in U.S. Appl. No. 14/726,374, dated Jul. 13, 2017, 30 pages.

United States Office Action in U.S. Appl. No. 14/726,374, dated Apr. 10, 2017, 6 pages.

Chinese Office Action in Chinese Application No. 201510290256.5, dated Jan. 22, 2017, 21 pages (with English translation).

Office Action issued in Russian Application No. 2015119054 dated Jul. 15, 2016, 7 pages (with English translation).

European Search Report dated Oct. 28, 2015 for European Application No. 15170116.6, 7 pages.

United States Office Action in U.S. Appl. No. 16/191,734, dated Oct. 8, 2020, 28 pages.

U.S. Final Office Action in U.S. Appl. No. 16/191,734, dated Apr. 26, 2021, 29 pages.

LAUNDRY TREATMENT APPARATUS

CROSS-REFERENCE TO RELATED APPLICATIONS

This application is a divisional of U.S. application Ser. No. 15/281,455, filed Sep. 30, 2016, which is a divisional of U.S. application Ser. No. 14/726,374, filed May 29, 2015, now U.S. Pat. No. 9,945,064, which claims the benefit of Korean Patent Application Nos. 10-2014-0065885, filed on May 30, 2014 and 10-2015-0069663, filed on May 19, 2015, which are hereby incorporated by reference as if fully set forth herein.

TECHNICAL FIELD

The present disclosure relates to a laundry treatment apparatus.

BACKGROUND

Generally, a laundry treatment apparatus is understood to include an apparatus adapted to wash laundry, an apparatus adapted to dry laundry, and an apparatus adapted to perform both washing and drying of laundry.

A front-loading laundry treatment apparatus (also called a drum washing machine) is constructed to allow laundry to be put into the apparatus from the front of the apparatus and has an introduction port through which laundry can be put into the apparatus. Since the front-loading laundry treatment apparatus has an introduction port positioned at a level lower than a user's waist, use of the apparatus is inconvenient in that a user has to stoop when the user puts laundry into the apparatus or takes laundry out of the apparatus.

In order to reduce or eliminate such inconvenience, among conventional laundry treatment apparatuses, a laundry treatment apparatus in which a support platform is additionally provided at a front-loading laundry treatment apparatus has been proposed.

However, the support platform provided at the conventional laundry treatment apparatus is merely intended to raise the height of an introduction port and cannot perform a function of laundry treatment such as washing or drying of laundry.

SUMMARY

A laundry treatment apparatus is detachably coupled to another laundry treatment apparatus to perform functions of washing and/or drying of laundry. In some implementations, the laundry treatment apparatus enables washing water to be easily supplied to or discharged from an accommodation unit retractably provided at a cabinet to accommodate laundry. In some implementations, the laundry treatment apparatus is configured to condense moisture discharged from the accommodation unit and to return the condensed water to the accommodation unit. The laundry treatment apparatus may also be configured to prevent washing water from remaining in a discharge unit serving to discharge washing water contained in an accommodation unit. In some implementations, the laundry treatment apparatus may be configured to circulate washing water in an accommodation unit.

In one aspect, a laundry treatment apparatus includes a cabinet and a drawer retractably provided in the cabinet. An accommodation unit is provided at the drawer and defines a space configured to receive washing water. The laundry treatment apparatus includes a guider. The guider includes a first body rotatably coupled to the cabinet, and a second body rotatably coupled to the first body and the drawer and configured to connect the first body to the drawer. A supply unit is connected to a water supply source. A water supply channel is provided along the guider and is configured to supply water between the supply unit and the accommodation unit.

In some implementations, the water supply channel includes a first supply channel provided along the first body and connected to the supply unit; and a second supply channel provided along the second body and configured to supply washing water from the first supply channel to the accommodation unit.

In some implementations, the first supply channel is formed as an internal channel inside the first body, and second supply channel is formed as an external water supply pipe supported by the second body.

In some implementations, the first supply channel is formed as an internal channel inside the first body; and the second supply channel is formed as an internal channel inside the second body.

In some implementations, the first supply channel is formed as an external water supply pipe supported by the first body; and the second supply channel is formed as an internal channel inside the second body.

In some implementations, the first supply channel is formed as an external water supply pipe supported by the first body; and the second supply channel is formed as an external water supply pipe supported by the second body.

In some implementations, the laundry treatment apparatus further includes a through hole through which washing water is introduced into the accommodation unit. The second supply channel is configured to penetrate the drawer and an end portion of the second supply channel is configured to be coupled to the through hole.

In some implementations, at least part of the second supply channel includes a flexible structure or an elastic material.

In some implementations, the end portion of the second supply channel that is positioned between the through hole and the drawer includes a flexible structure or an elastic material.

In some implementations, the laundry treatment apparatus further includes a water supply opening provided at the drawer and configured to be connected to an end portion of the second supply channel. A through hole is configured to supply washing water to the accommodation unit. An intermediate connecting member is connected between the water supply opening and the through hole and includes a flexible structure or an elastic material.

In some implementations, the supply unit includes a first valve and a second valve that are connected to respective water supply sources and are configured to supply washing water of different temperatures. The water supply channel includes a first connecting pipe connected between the first supply channel and the first valve, and a second connecting pipe connected between the first supply channel and the second valve.

In some implementations, the laundry treatment apparatus further includes a discharge unit configured to discharge washing water from the accommodation unit to the outside of the accommodation unit. A water discharge channel is provided along the guider and is configured to guide washing water supplied from the discharge unit to the outside of the cabinet.

In some implementations, the water discharge channel is formed as an external water supply pipe supported by the guider.

In some implementations, the first body includes a base; and a cover thermally fused to the base, the base and the cover together forming the first supply channel.

In some implementations, the water discharge channel includes a first discharge channel provided along the first body; a first water discharge pipe that is connected between the first discharge channel and the discharge unit; and a second water discharge pipe connecting the first discharge channel to the outside of the cabinet.

In some implementations, the first body is positioned at an upper portion of a rear surface of the drawer when the drawer is in a closed position.

In some implementations, the first body is configured to have a recessed portion that is configured to accommodate an upper edge of the rear surface of the drawer when the drawer is in the closed position.

In some implementations, the first supply channel is positioned at an upper surface of the drawer to be parallel to the upper surface of the drawer. The first discharge channel provided along the first body is positioned at a rear surface of the drawer to be parallel to the rear surface of the drawer.

In some implementations, the laundry treatment apparatus further includes a discharge unit configured to discharge washing water from the accommodation unit to the outside of the accommodation unit. A water discharge channel is provided along the guider and is configured to guide washing water supplied from the discharge unit to the outside of the cabinet.

In some implementations, the laundry treatment apparatus further includes a support body fixed to the cabinet and by which the first body is rotatably supported. A discharge pipe is provided along the support body extending through the cabinet and is configured to guide washing water supplied through the water discharge channel to the outside of the cabinet.

In some implementations, the laundry treatment apparatus further includes a shaft support provided along the support body and by which the first body is rotatably supported.

In some implementations, the laundry treatment apparatus further includes a shaft support provided along the discharge pipe and by which the first body is rotatably supported.

In some implementations, a portion of the water discharge channel that is connected to the discharge pipe has a flexible structure or is made of an elastic material.

In some implementations, the water discharge channel includes a first discharge channel provided along the first body and separated from the first supply channel; a first water discharge pipe connected between the first discharge channel and the discharge unit; and a second water discharge pipe connected between the first discharge channel and the discharge pipe.

In some implementations, the second water discharge pipe has a flexible structure or is made of an elastic material.

In some implementations, the first body includes a base; and a cover thermally fused to the base such that the cover and the base together form the first supply channel and the first discharge channel.

In some implementations, the laundry treatment apparatus further includes a first discharge channel inlet provided at the first body and connected between the first water discharge pipe and the first discharge channel. A communication pipe is connected between the first discharge channel inlet and the second supply channel.

In some implementations, the second body includes first and second flanges spaced apart from each other by a predetermined distance and configured to define an accommodation space for accommodating the second supply channel.

In some implementations, the laundry treatment apparatus further includes a water supply pipe attachment provided at least one of the first and second flanges and configured to detachably hold the second supply channel on an inner surface of the accommodation space. A communication pipe attachment is provided at one of the first and second flanges and is configured to detachably secure the communication pipe to an outer surface of the accommodation space.

In some implementations, the laundry treatment apparatus further includes a support configured to hold the accommodation unit in the drawer in a movable manner.

It is to be understood that both the foregoing general description and the following detailed description are exemplary and explanatory and are intended to provide further explanation of the subject matter as claimed.

DETAILED DESCRIPTION

Hereinafter, a laundry treatment apparatus is described that includes both a first treatment apparatus T and a second treatment apparatus L.

Figure 1:
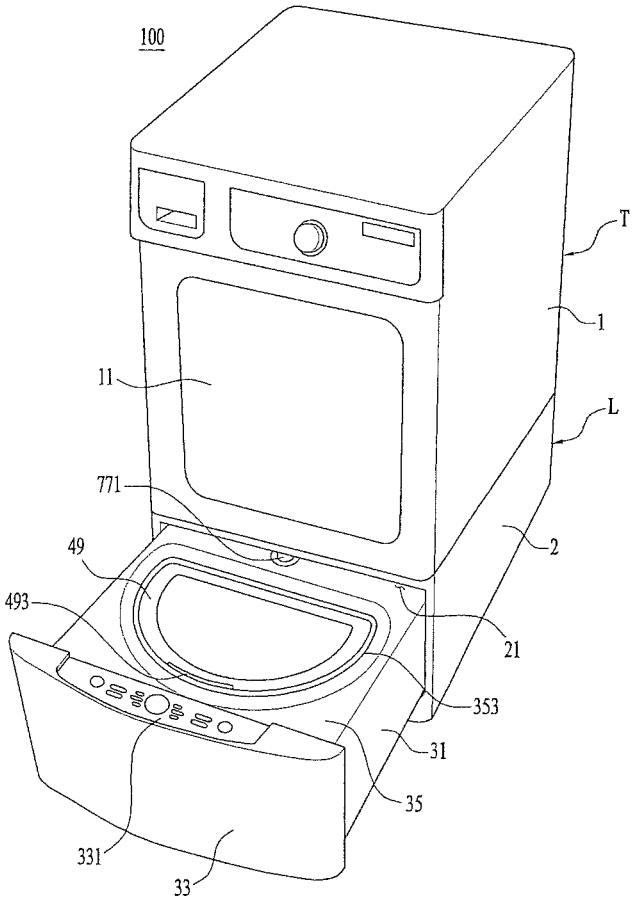
FIG. 1 is a perspective view showing an example of a laundry treatment apparatus.

FIG. 1 illustrates an example laundry treatment apparatus 100. The first treatment apparatus T according may include a first treatment apparatus cabinet 1 defining an exterior appearance, a first treatment apparatus tub (not shown) disposed in the first treatment apparatus cabinet 1 to contain washing water therein, a first treatment apparatus drum (not shown) rotatably disposed in the first treatment apparatus tub to contain laundry, a first treatment apparatus water supply unit (not shown) for supplying washing water to the first treatment apparatus tub, and a first treatment apparatus water discharge unit (not shown) for discharging washing water contained in the first treatment apparatus tub to the outside of the first treatment apparatus cabinet 1.

The first treatment apparatus cabinet 1 includes a first treatment apparatus introduction port (not shown) through which laundry is put into the cabinet 1 or taken out of the cabinet 1. The first treatment apparatus introduction port is opened and closed by a first treatment apparatus door 11 hinged to the first treatment apparatus cabinet 1.

The first treatment apparatus tub includes a first treatment apparatus tub introduction port communicating with the first treatment apparatus introduction port, and thus a user can put laundry into the first treatment apparatus drum upon opening of the first treatment apparatus door 11.

When the first treatment apparatus T is designed to also perform a function of drying of laundry, the first treatment apparatus cabinet 1 has to be provided therein with a hot air supply unit (not shown) for supplying hot air to the first treatment apparatus tub.

The hot air supply unit (not shown) may include a circulation duct for circulating air in the first treatment apparatus tub, and a heat exchange unit disposed at the circulation duct to dehumidify and heat the air discharged from the first treatment apparatus tub.

Alternatively, the hot air supply unit (not shown) may also include a discharge duct for discharging air in the first treatment apparatus tub to the outside of the first treatment apparatus cabinet 1, a supply duct for supplying air from outside the first treatment apparatus cabinet 1 to the first treatment apparatus tub, and a heat exchange unit disposed at the supply duct.

Unlike the above construction, if the first treatment apparatus T is designed to perform a function of drying of laundry, the first treatment apparatus may not need the first treatment apparatus tub. In this case, the hot air supply unit has to supply hot air to the first treatment apparatus drum provided in the first treatment apparatus cabinet 1.

The second treatment apparatus L incorporated in the laundry treatment apparatus includes a cabinet 2 detachably provided at the first treatment apparatus cabinet 1, a drawer 3 disposed in the cabinet 2 to be retractable therefrom, and an accommodation unit 4-5 disposed in the drawer 3 and serving as a treatment space of laundry. In some examples, the accommodation unit 4-5 may include a tub 4 and a drum 5.

The cabinet 2, which defines an exterior appearance of the second treatment apparatus L, may support the first treatment apparatus cabinet 1. Unlike the cabinet shown in FIG. 1, the cabinet 2 provided at the second treatment apparatus may be detachably provided at an upper surface or a side surface of the first treatment apparatus cabinet 1.

However, since a height of the first treatment apparatus door 11 is increased when the second treatment apparatus L is positioned under the first treatment apparatus T, it is convenient for a user to put laundry into the treatment apparatus or to take laundry out of the treatment apparatus.

The cabinet 2 includes an open surface 21 such that the drawer 3 is withdrawn from the cabinet 2 through the open surface 21 or is accommodated in the cabinet 2. When the second treatment apparatus L is provided at a bottom surface of the first treatment apparatus T, the open surface 21 may be disposed at a side (a front side of the first treatment apparatus T) at which the first treatment apparatus door 11 is positioned.

Figure 2:
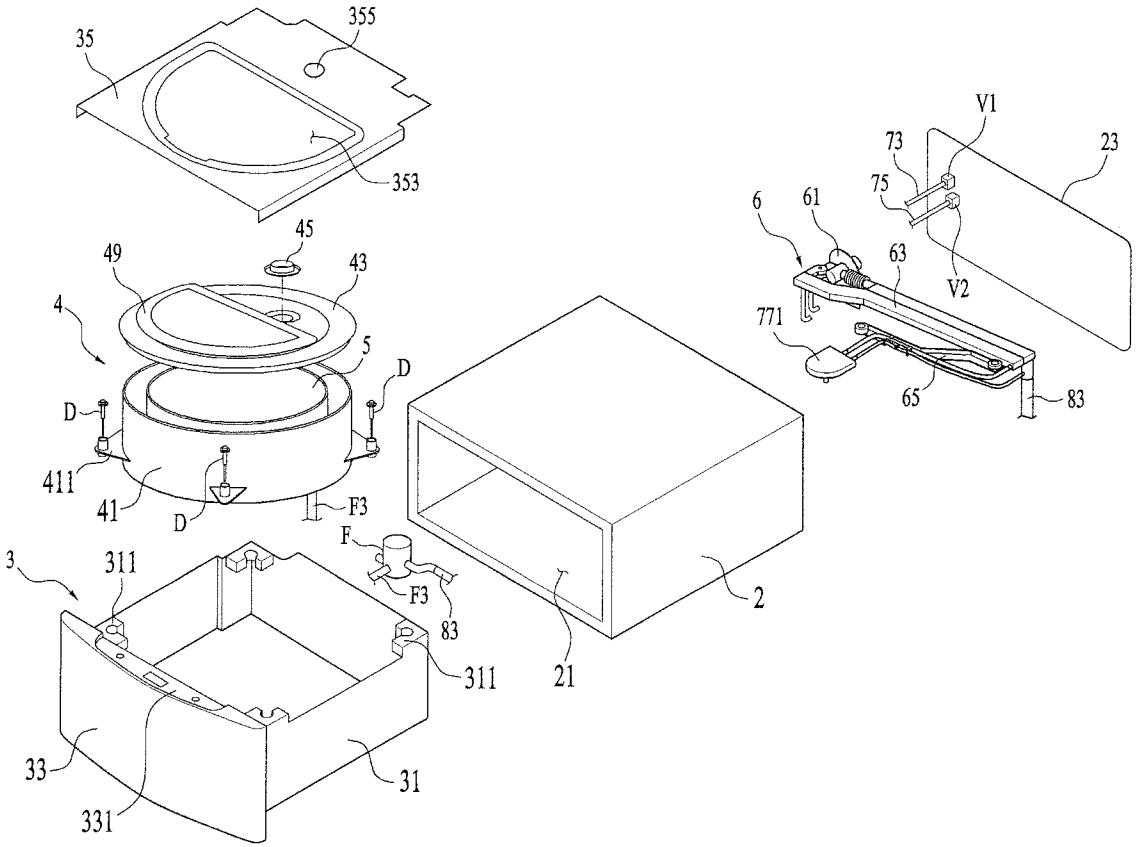
FIG. 2 is an exploded perspective view of an example of a laundry treatment apparatus.

As shown in FIG. 2, the drawer 3 includes a drawer body 31 having an open upper surface, and a drawer cover 35 disposed at the open upper surface of the drawer body 31.

The drawer body 31 may be configured to have a hexahedral shape having a hollow cavity defined therein. The drawer cover 35 is fixed to the drawer body 31 to define the upper surface of the drawer body 31.

The drawer body 31 is provided at a front surface thereof with a drawer panel 33. The drawer panel 33 may include a handle (not shown). In this case, a user can draw the drawer body 31 disposed in the cabinet 2 from the cabinet 2 using the handle.

The drawer panel 33 may include a control panel 331 for controlling operation of the second treatment apparatus L. The control panel 331 serves to allow a user to input control commands for control of units for supplying washing water to the accommodation unit 4-5 and discharging the washing water from the accommodation unit 4-5, a unit for rotating laundry, units for supplying steam or hot air to laundry and the like.

The control panel 331 may also serve to allow a user to check control commands input by a user and to display an execution state of the control commands input by the user.

The drawer cover 35 may be provided with an introduction opening 353 formed through the drawer cover 35 to communicate the inside of the drawer body 31 with the outside of the drawer body 31, and a water supply opening 355 formed through the drawer cover 35 to guide washing water to the accommodation unit 4-5.

The accommodation unit 4-5 provided in the drawer 3 may include a tub 4 provided in the drawer body 31 to provide a space for containing laundry, and a drum 5 rotatably provided in the tub 4 to contain laundry.

The tub 4 may include a tub body 41 having a space for containing washing water and having an open upper surface, and a tub cover 43 fixed to the upper surface of the tub body 41. The drum 5 may be configured to have a cylindrical shape having an open upper surface.

Figure 3A:
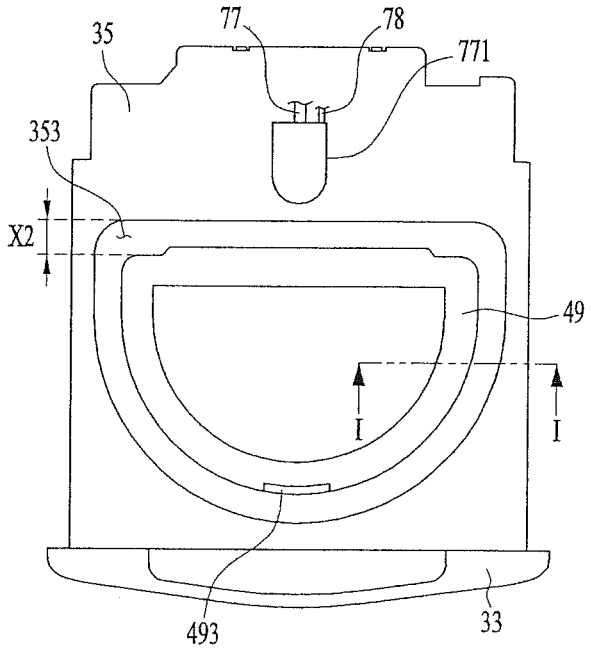
FIGS. 3A and 3B are views showing examples of a drawer, a tub and a door of a laundry treatment apparatus.
Figure 3B:
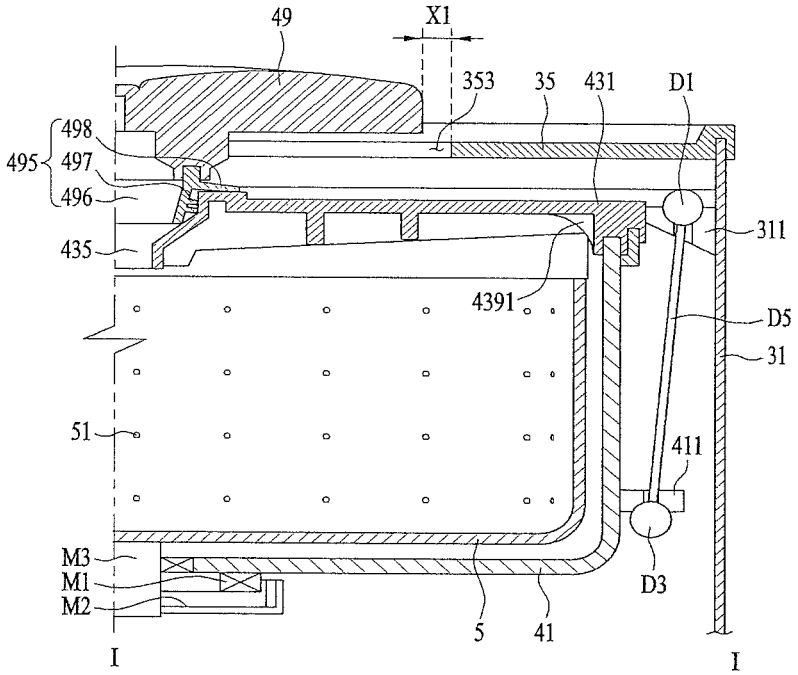

As shown in FIGS. 3A and 3B, the drum 5 may be rotatable in the tub body 41 by means of a driving unit provided outside the tub body 41. The driving unit may include a stator M1 fixed to the tub body 41 to generate a rotating magnetic field, a rotor M2 which is rotated by the rotating magnetic field, and a driving shaft M3 extending through the tub body 41 and connecting the drum 5 to the rotor M2.

The drum 5 includes drum through holes 51 formed at an outer circumferential surface thereof to communicate the inside of the drum 5 with the inside of the tub body 41.

The tub body 41 is held in the drawer body 31 by means of tub supports D.

Each of the tub supports D may include a drawer connecting portion D1, a tub connecting portion D3, and a rod D5 connecting the tub connecting portion D3 to the drawer connecting portion D1.

Here, the drawer body 31 may be provided with a first bracket 311 for supporting the drawer connecting portion D1, and the tub body 41 may be provided at an outer circumferential surface thereof with a second bracket 411 supported by the tub connecting portion D3.

The first bracket 311 may be provided at the drawer body 31, and the second bracket 411 may protrude toward the inner surface of the drawer body 31 from the outer circumferential surface of the tub body 41.

The tub cover 43 includes a cover body 431 defining an upper surface of the tub body 41, and a tub introduction port 435 formed through the cover body 431 to communicate the introduction opening 353 with the drum 5.

The tub introduction port 435 is provided with a door 49 hinged to the cover body 431.

The door 49 is coupled to the cover body 431 of the tub cover 43 by means of a hinge (not shown). The introduction opening 353 is positioned over the tub introduction port 435. The door 49 or the tub introduction port 435 has a smaller size than that of the introduction opening 353. Accordingly, even though the tub introduction port 435 is positioned below the drawer cover 35, the tub introduction port 435 may be opened and closed by the door 49.

Particularly, the outer circumferential surface of the door may be spaced apart from the inner circumferential surface of the introduction opening 353 by predetermined distances X1 and X2 in order to avoid a problem that the door 49 cannot be opened because of interference between the door 49 and the introduction opening 353 caused by geometric tolerance or positional tolerance.

Furthermore, when the outer circumferential surface of the door 49 is spaced apart from the inner circumferential surface of the introduction opening 353 by a predetermined interval, it is possible to also mitigate or prevent breakage of the door due to vibration of the tub.

The door 49 may be provided with a door handle 493 which detachably secures the door 49 to the drawer cover 35 or the cover body 431 of the tub cover 43.

The door 49 may be provided with a sealing unit 495 for mitigating or preventing washing water from leaking through the tub introduction port 435.

The sealing unit 495 may include a sealing body 496 fixed to a lower surface of the door 49, which is fitted in the tub introduction port 435 upon closing the tub introduction port 435, and first and second protrusions 497 and 498 protruding from the sealing body 496.

The first protrusion 497 protrudes toward the inner circumferential surface of the tub introduction port 435 from the outer circumferential surface of the sealing body 496. The first protrusion 497 may have a length sufficient to contact the inner circumferential surface of the tub introduction port 435 when the tub introduction port 435 is closed by the door 49.

The first protrusion 497 may include two or more protrusions provided at the sealing body 496. The two or more first protrusions 497 may be spaced apart from each other by a predetermined interval.

The second protrusion 498 may protrude from the outer circumferential surface of the sealing body 496 so as to close the tub introduction port 435 when the tub introduction port 435 is closed by the door 49. In other words, the second protrusion 498 must have a length sufficient to contact the upper surface of the cover body 431 of the tub cover 43 when the tub introduction port 435 is closed by the door 49.

Although the sealing unit 495 may be made of any materials so long as it can seal the tub introduction port 435 when the tub introduction port 435 is closed by the door 49, as an example, the sealing unit 495 may be made of an elastic material such as rubber.

Figure 4A:
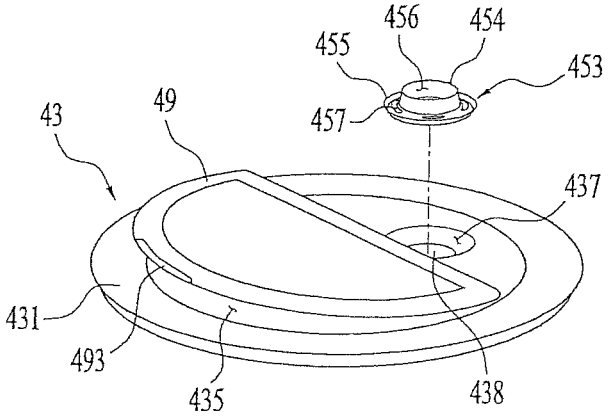
FIGS. 4A, 4B, and 4C are views showing examples of a tub cover of a laundry treatment apparatus.
Figure 4B:
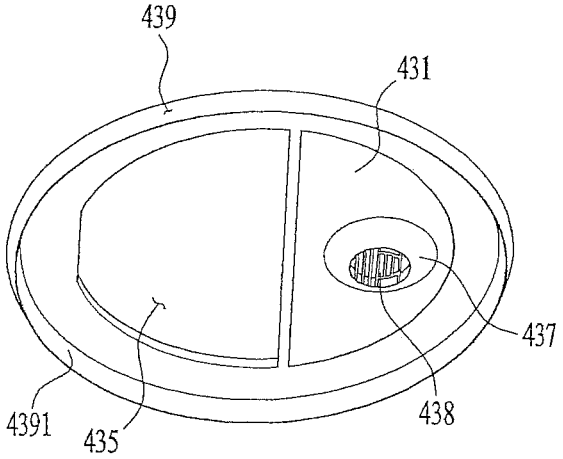
Figure 4C:
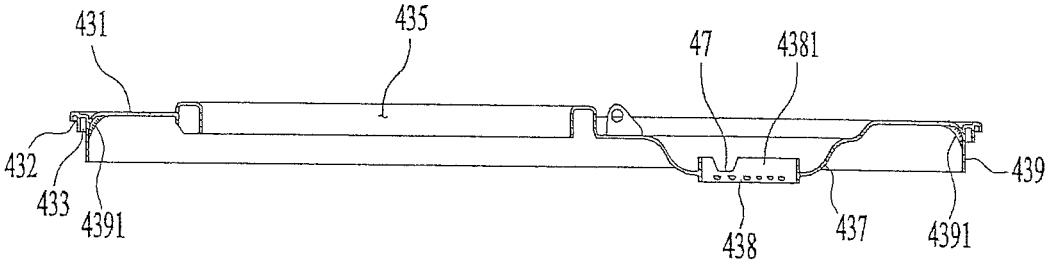

As shown in FIGS. 4A, 4B, and 4C, the cover body 431, which defines the upper surface of the tub body 41, includes a fitting rib 439 fitted in the inner circumferential surface of the tub body 41. The fitting rib 439 may be provided with an inclined portion 4391 for guiding washing water in the tub body 41 into the drum 5.

The drum 5 disposed in the tub body 41 is configured to have a cylindrical shape having an open upper surface. The drum 5 includes drum through holes 51 which are formed at an outer circumferential surface thereof to communicate the inside of the drum 5 with the inside of the tub body 41.

In this example, when the drum 5 rotates, washing water contained in the tub body 41 may rise to the tub cover 43 from the bottom surface of the tub body 41 while rotating along the inner circumferential surface of the tub body 41. At this time, the inclined portion 4391 serves to guide washing water having moved to the tub cover 43 from the bottom surface of the tub body 41, toward the upper surface of the drum 5.

When the washing water is again supplied to the drum 5 through the upper surface of the drum 5, washing water can strike laundry contained in the drum 5. Consequently, the laundry treatment apparatus can improve washing performance by virtue of the inclined portion 4391.

The cover body 431 of the tub cover 43 includes a through hole 438 which is disposed under the water supply opening 355 formed through the drawer cover 35 to guide washing water introduced to the water supply opening 355 to the drum 5.

Since the tub 4 is fixedly disposed in the drawer 3, the through hole 438 that passes through the tub cover 43 is theoretically considered to be fixed under the water supply opening 355 that passes through drawer cover 35 (it is considered that significant relative movement between the through hole and the water supply hole does not occur). Accordingly, it is also possible to supply washing water to the tub 4 through the water supply opening 355 and through a connection to the through hole 438. The connection between the through hole 438 and the water supply opening 355, may be constituted by a flexible hose or a bellows hose or may be made of an elastic material.

In some cases, the connection between the through hole 438 and the water supply opening 355 may be a separate intermediate connecting member, such as a pipe. In such cases, the water supply opening 355 may be configured to connect with a water supply pipe (a second supply channel) 77 that provides water to the tub 4. As such, water may be supplied from the water supply pipe 77 through the water supply opening 355 in the drawer cover 35, through the intermediate connecting member, and through the tub cover 43 via the through hole 438.

In some cases, there may be no separate intermediate connecting member, and instead the connection between the through hole 438 and the water supply opening 355 may be part of the water supply pipe 77 itself. For example, the water supply pipe 77 may be configured with an end portion that extends into the inside of the drawer through the water supply opening 355 and is directly connected to the through hole 438 of the tub cover 43. In this case, the water supply pipe 77 may have an end portion that is an elastic or flexible structure in at least a portion thereof. The end portion of the water supply pipe 77, which has the flexible or elastic structure, may be positioned between the through hole 438 and the drawer cover 35 (the upper surface of the drawer).

In some scenarios, the connection between the through hole 438 and the water supply opening 355 may vibrate significantly when vibration generated during rotation of the drum 5 is transmitted to the tub body 41. In this case, problems may arise with the durability of the connection becoming deteriorated such that the laundry treatment apparatus may be configured with a structure for attenuating vibration of the connection. Alternatively, in some examples, washing water may be supplied to the tub 4 by positioning the through hole 438 under the water supply opening 355 without using a connection between the through hole 438 and the water supply opening 355.

In such cases in which there is no physical connection between the through hole 438 and the water supply opening 355, when hot water is supplied to the tub body 41 or steam is supplied to the tub body 41 from a steam generation device (not shown), there may arise a problem that moisture (water, steam, mist, etc.) in the tub body 41 is discharged into the cabinet 2 through an open gap formed between the through hole 438 and the water supply opening 355.

Specifically, when moisture in the tub body 41 is discharged in to the cabinet 2 through the through hole 438, washing performance may be deteriorated and devices (electronic devices) disposed in the cabinet 2 may fail or corrode. Accordingly, in cases where there is no physical connection between the through hole 438 and the water supply opening 355, the laundry treatment apparatus may include a recovery unit for minimizing moisture or heat that is discharged from the tub body 41 into the cabinet 2 through the through hole 438.

Figure 5A:
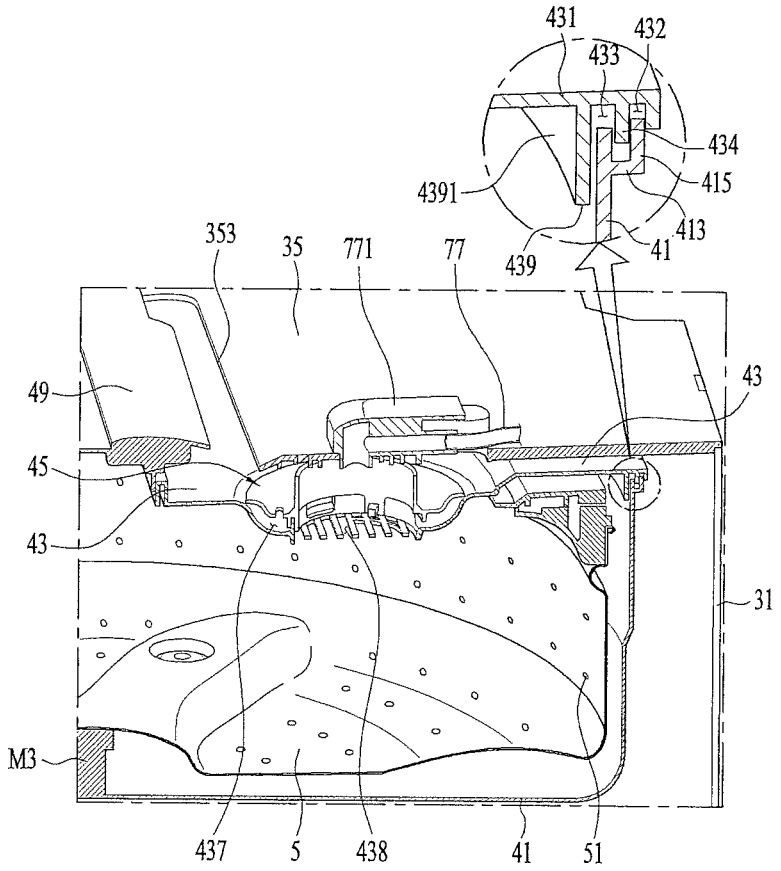
FIGS. 5A and 5B are views showing examples of a recovery unit of a laundry treatment apparatus.
Figure 5B:
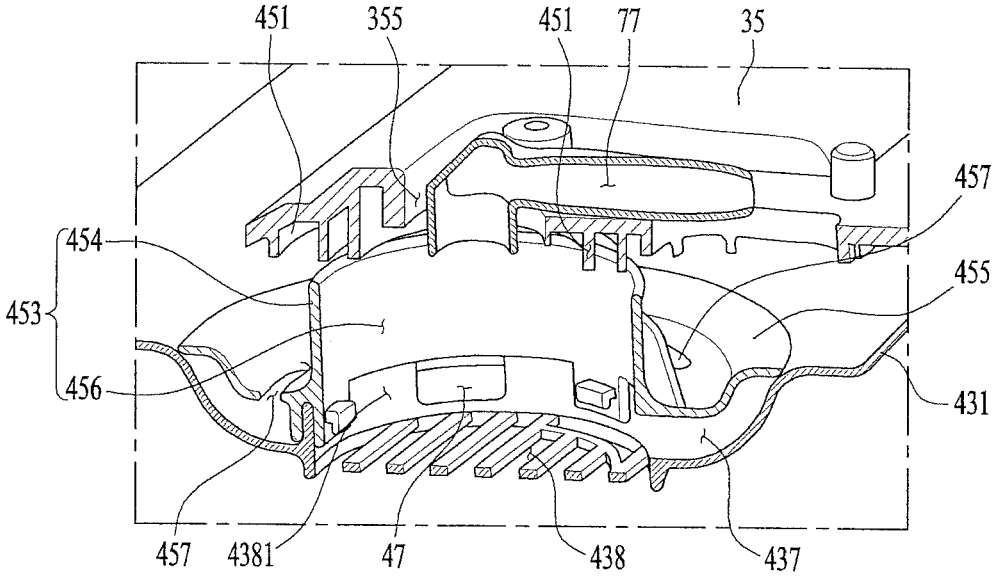

As shown in FIGS. 5A and 5B, the recovery unit 45 incorporated in the laundry treatment apparatus may include a first recovery part 451 provided at the drawer cover 35 and contacting moisture discharged from the through hole 438, and a second recovery part 453 for guiding moisture supplied from the first recovery part 451 to the through hole 438.

The second recovery part 453 may include a recovery body 454 protruding toward the first recovery part 451 from the upper surface of the tub cover 43, and a body through hole 456 formed through the recovery body 454 and communicating with the through hole 438.

The first recovery part 451 may be configured to have any shape so long as it can guide moisture discharged from the through hole 438 to the second recovery part 453.

Specifically, the first recovery part 451 may be configured into a flat or curved board shape protruding toward the second recovery part 453 from the drawer cover 35, and may also be configured into a hollow bar shape having an open surface facing the second recovery part 453.

When the first recovery part 451 is configured into the hollow bar shape, the hollow bar may be variously configured. FIGS. 5A and 5B illustrate examples in which the hollow bar is configured into a cylindrical shape.

When the first recovery part 451 is configured into the flat board, the first recovery part 451 may be positioned in the body through hole 456.

In other words, when the first recovery part 451 includes a plurality of boards, the plurality of boards may be positioned in a space which is defined by projection of the through hole 456 to the drawer cover 35 (through hole projection space) in order to supply moisture (water or condensed water) fallen toward the second recovery part 453 from the plurality of boards to the through hole 438 through the body through hole 456.

Meanwhile, when the first recovery part 451 includes a plurality of hollow bars, the hollow bars may be positioned in the through hole projection space.

Specifically, when the plurality of hollow bars are arranged to have the same center, the hollow bar having the largest surface area has to be positioned in the through hole projection space. However, when the plurality of hollow bars are not arranged to have the same center, the space defined by the plurality of hollow bars has to be positioned in the through hole projection space.

The first recovery part 451 may be configured so as to not interfere with the water supply opening 355 regardless of the shape of the first recovery part 451. Furthermore, the free ends of the first recovery part 451 may be configured so as to not interfere with the free end of the recovery body 454.

This mitigates or prevents a problem that the first recovery part 451 collides with the recovery body 454 owing to vibration transmitted to the tub body 41 during rotation of the drum 5 and thus the first recovery part 451 or the second recovery part 453 is broken.

The first recovery part 451 may be made of any materials so long as the first recovery part 451 is constituted by means for mitigating or preventing water discharged from the tub 4 from spreading in the drawer 3 (for guiding water discharged from the tub 4 to the second recovery part).

When the first recovery part 451 is constituted by means for condensing moisture discharged from the tub 4 (exchanging heat with moisture discharged from the tub 4) and guiding the condensed water to the second recovery part, the first recovery part 451 may be made of a metal material. In this case, the second recovery part 453 may be made of an elastic material.

The recovery unit 45 may further include the following components in order to increase recovered amount and condensed amount of moisture.

Specifically, the tub cover 43 may further include a reception recess 437 formed at the cover body 431 to be concave and at which the through hole 438 is positioned. The second recovery part 453 may further include a body flange 455 protruding from an outer surface of the recovery body 454 and positioned over the reception recess 437, and a flange through hole 457 formed through the body flange 455.

Here, the first recovery part 451 may be positioned in a space which is defined by projection of the body flange 455 to the drawer cover 35 (flange projection space).

In other words, when the first recovery part 451 is constituted by a board, the first recovery part 451 may protrude toward the recovery body 454 from the drawer cover 35 such that the first recovery part 451 is positioned in the flange projection space.

Meanwhile, when the first recovery part 451 is constituted by a plurality of hollow bars, the plurality of hollow bars may be positioned in the flange projection space.

Even if the plural hollow bars are arranged so as not to have the same center, a range defined by the hollow bars (a range defined by connection of hollow bars positioned at the periphery) may still be positioned in the flange projection space.

However, when the plurality of hollow bars are constituted by cylinders having the same center, the hollow bar having the greatest diameter may be positioned in the flange projection space positioned outside the through hole projection space and the hollow bar having the smallest diameter may be positioned in the through hole projection space.

If the plurality of hollow bars have the same center but do not have the cylindrical shape, the hollow bar having the greatest surface area has to be positioned in the flange projection space and the hollow bar having the smallest surface area has to be positioned in the through hole projection space.

In conclusion, regardless of shape of the plurality of hollow bars, the hollow bar having the greatest surface area may be configured to be smaller than that of the flange projection space but larger than that of the through hole projection space. Furthermore, the hollow bar having the greatest surface area may be configured to have a smaller surface area than that of the through hole projection space.

When the first recovery part 451 is constituted by a plurality of hollow bars having the same center, the centers of the respective hollow bars may be positioned at the water supply opening 355. In this case, distances between the respective hollow bars may be regular or irregular.

Since the first recovery part 451 is held by the drawer cover 35 and the drawer cover 35 may exchange heat with outside air (e.g., in a continuous manner), the surface temperature of the first recovery part 451 can be maintained to be lower than the temperature of air discharged from the through hole 438.

Furthermore, when the first recovery part 451 is provided near the water supply opening 355, the first recovery part 451 may further decrease in surface temperature by directly exchanging heat with cool water supplied through the water supply opening 355 or outside air introduced through an area around the water supply opening 355, thus improving cooling performance of the first recovery part 451.

The recovery unit 45 has to further include a recovery hole 47 for guiding moisture introduced into the reception recess 437 through the flange through hole 457 to the through hole 438.

When the reception recess 437 is provided with a support pipe 4381 that protrudes toward the first recovery part 451 to support a lower surface of the recovery body 454, the recovery hole 47 may be formed through the support pipe 4381. However, when the recovery body 454 is directly fixed to a circumferential surface of the through hole 438, the recovery hole 47 has to be formed through the recovery body 454.

In any case, the inner surface of the reception recess 437 may be inclined such that condensed water in the reception recess 437 flows toward the recovery hole 47.

Although the laundry treatment apparatus has been described in connection with examples in which the recovery unit 45 includes both the first recovery part 451 and the second recovery part 453, the recovery unit 45 may include only the first recovery part 451 positioned over the through hole 438.

The reason is because steam discharged from the through hole 438 will be condensed on a surface of the first recovery part 451 and then introduced into the through hole 438 by gravity, and water discharged from the through hole 438 will come into contact with the surface of the first recovery part 451 and then will be introduced into the through hole 438 by gravity.

For coupling of the tub cover 43 to the tub body 41, the tub cover 43 may further include a first fitting groove 432 having a larger diameter than that of the fitting rib 439, and a second fitting groove 433 positioned between the first fitting groove 432 and the fitting rib 439.

In this case, the upper end of the tub body 41 may be fitted in the second fitting groove 433 and a fitting member 413-415 provided at an outer circumferential surface of the tub body 41 may be fitted in the first fitting groove 432.

The fitting member may include a first fitting member body 413 protruding from the outer circumferential surface of the tub body 41 outward, and a second fitting member body 415 protruding toward the tub cover 43 from the first fitting member body 413 and fitted in the second fitting groove 433.

In addition, the tub cover 43 may further include a fitting groove partition 434 for discriminating the first fitting groove 432 from the second fitting groove 433. The fitting groove partition 434 is fitted in a groove formed between the second fitting member body 415 and the outer circumferential surface of the tub body 41.

In some examples, as a consequence of the above coupling structure between the tub body 41 and the tub cover 43, the laundry treatment apparatus can reduce or minimize the washing water or steam outwardly leaking through between the tub body 41 and the tub cover 43 from the tub body 41.

Unlike the above structure, the fitting member 414-415 may be positioned in the tub body 41. In other words, the second fitting member body 415 may have a smaller diameter than that of the tub body 41.

In this case, the second fitting member body 415 may be fitted in the second fitting groove 433 and the upper end of the tub body 41 may be fitted in the first fitting groove 432.

The laundry treatment apparatus, which is constructed as described above, supplies washing water into the tub body 41 through a water supply channel, and discharges the washing water in the tub body 41 to the outside of the cabinet 2 through a water discharge channel.

Figure 6:
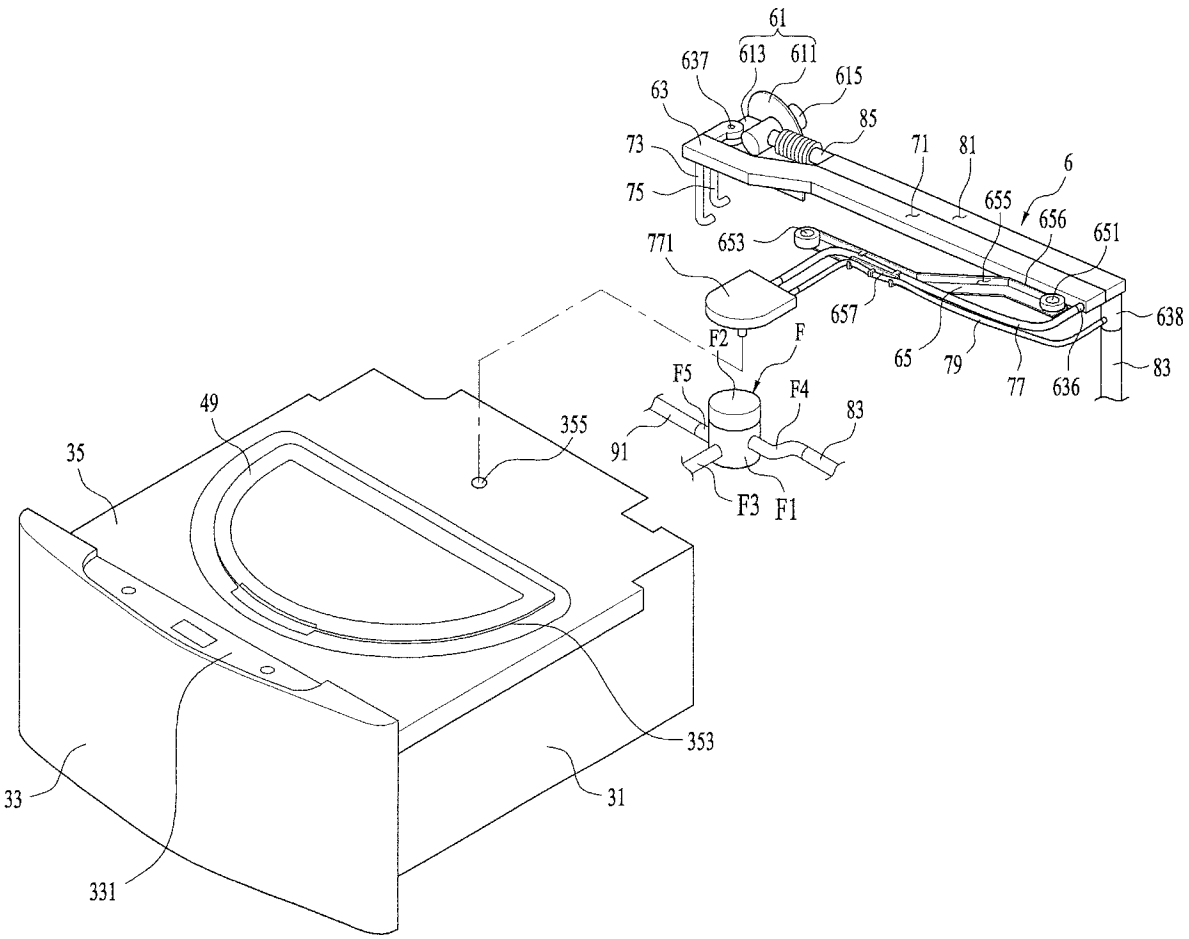
FIGS. 6, 7, 8A, 8B, and 8C are views showing examples of a guider of a laundry treatment apparatus.
Figure 7:
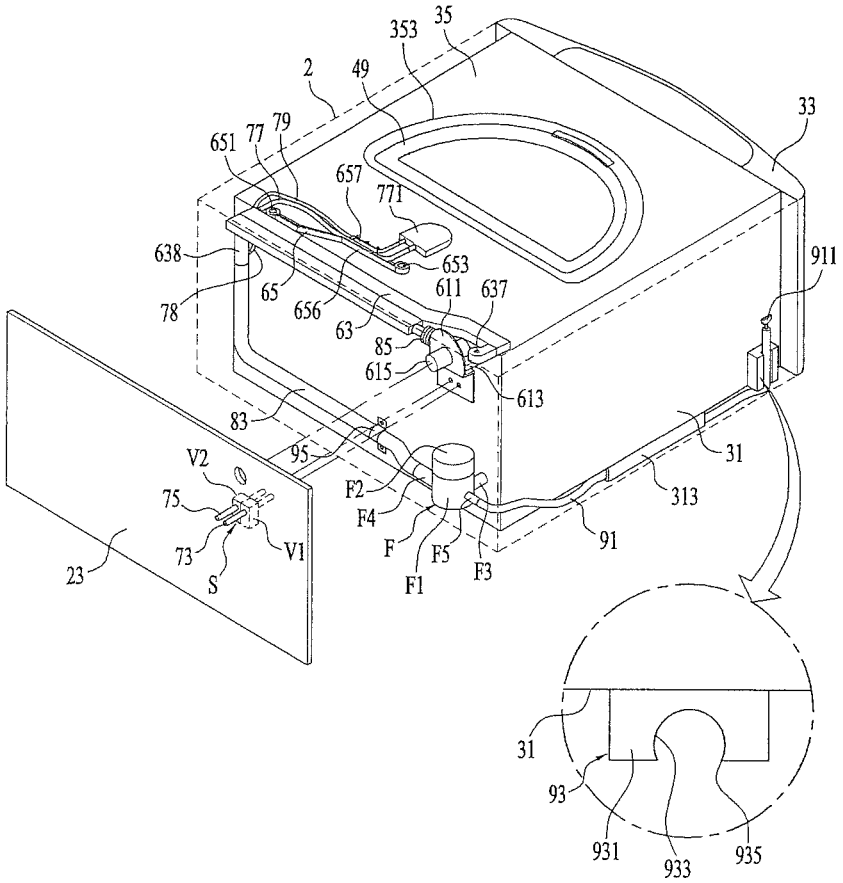

The water discharge channel has to be constructed to connect a discharge unit F (FIG. 6) fixed to the drawer 3 to a rear panel 23, and the water supply channel has to be constructed to connect the water supply opening 355 provided at the drawer 3 to a water supply source positioned outside the cabinet 2 through a supply unit S (FIG. 7).

Accordingly, if the water supply channel and the water discharge channel are merely constituted by a pipe connecting the supply unit S to the water supply opening 355 and a pipe connecting the water discharge unit F to the rear panel 23, respectively, there is a risk of the water supply channel or the water discharge channel becoming entangled or broken when the drawer 3 is withdrawn from the cabinet 2 or is pushed into the cabinet 2.

In order to avoid such risk, the laundry treatment apparatus 100 may further include a guider 6 which is provided in the cabinet 2 not only to serve as a water supply channel or a water discharge channel but also to guide movement of the water supply channel and the water discharge channel.

Hereinafter, the supply unit S and the discharge unit F are first described and then the guider 6, the water supply channel and the water discharge channel are described.

As shown in FIG. 6, the discharge unit F may be constituted by a pump fixed to the drawer body 31. The pump may include a housing F1 fixed to the drawer body 31 to contain washing water, and a motor F2 for rotating an impeller disposed in the housing F1.

The housing F1 is connected to the tub body via a housing introduction part F3 and connected to the water discharge channel via a first housing water discharge part F4. Accordingly, when the impeller is rotated by the motor F2, washing water contained in the tub body 41 is introduced into the housing F1 through the housing introduction part F3 and then introduced into the water discharge channel through the first discharge part F4.

As shown in FIG. 7, the supply unit S may include a first valve V1 connected to a first water supply source (washing water supply source of a first temperature), and a second valve V2 connected to a second water supply source (washing water supply source of a second temperature) for supplying washing water having a temperature different from the temperature of washing water supplied from the first water supply source. However, when there is only one water supply source provided outside the cabinet 2 to supply washing water, the supply unit S may include only one valve.

As shown in FIG. 6, the guider 6 may include a support 61 secured in the cabinet 2, a first body 63 rotatably connected to the support 61, and a second body 65 connecting the first body 63 to the drawer cover 35.

The support 61 may include a support body 611 fixed to the cabinet 2, a discharge pipe 615 provided at the support body 611 and extending through the rear panel 23, and a shaft support 613 supporting the first body 63.

The support body 611 may be secured to the rear panel 23 of the cabinet 2. In this case, the first valve V1 and the second valve V2 may be fixed to the support body 611.

The discharge pipe 615 serves to discharge washing water introduced to the water discharge channel to the outside of the cabinet 2. The shaft support 613 may be fixed to an outer surface of the discharge pipe 615 (see FIGS. 8A, 8B, and 8C) so as to minimize a size of the support 61.

Figure 8A:
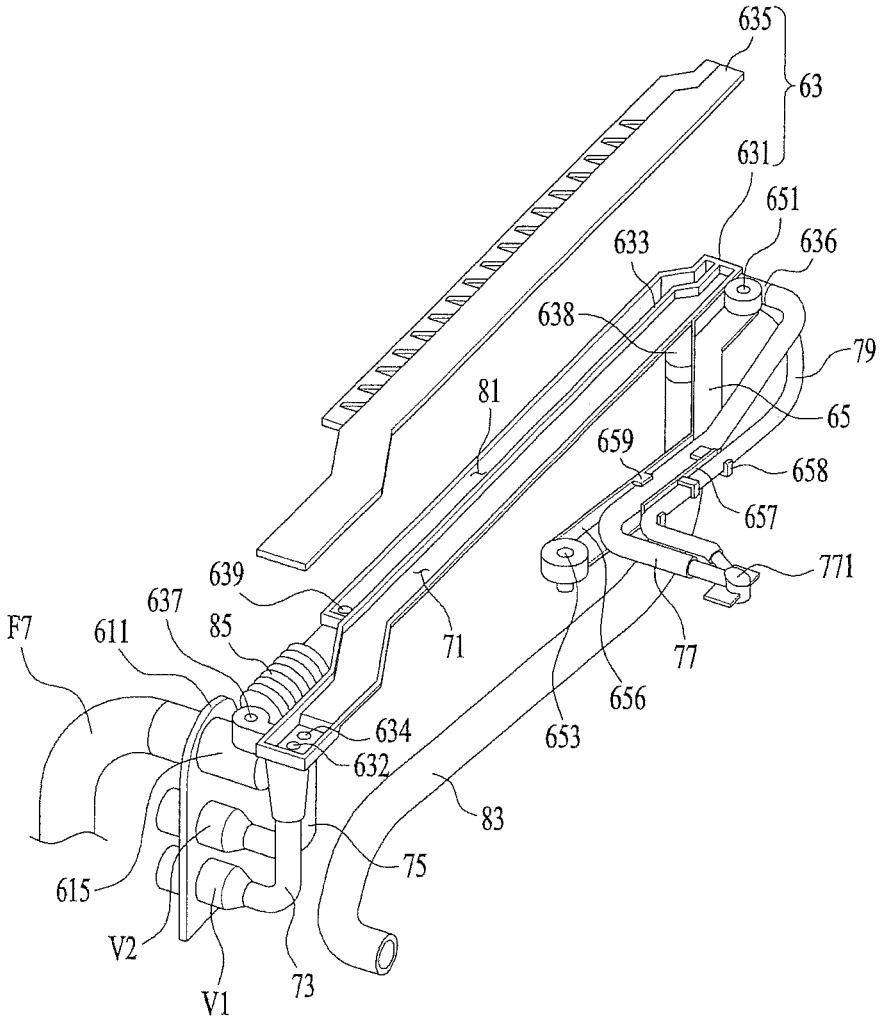
Figure 8B:
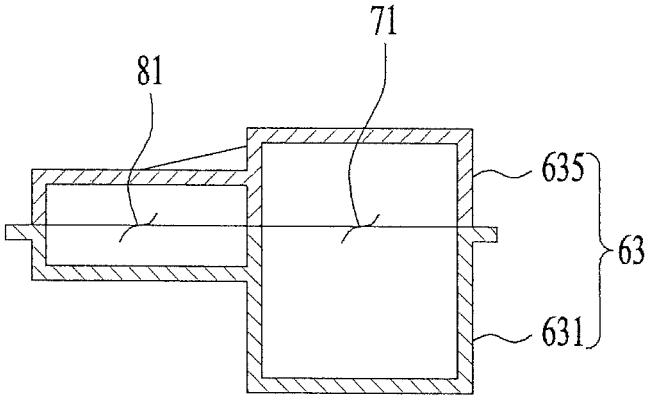
Figure 8C:
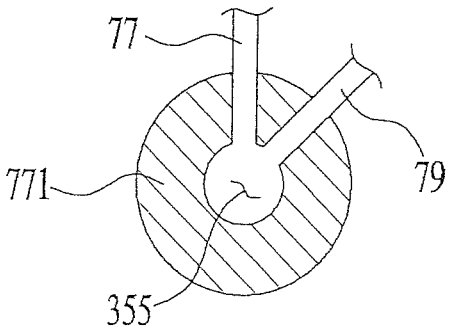

As shown in FIGS. 8A, 8B, and 8C, the first body 63 may include a base 631 defining a first supply channel 71 (body water supply pipe) connected to the supply unit S and a first discharge channel 81 (body water discharge pipe) connected to the discharge unit F, a cover 635 provided on the base 631 to close the first supply channel 71 and the first discharge channel 81, and a first shaft 637 for rotatably connecting the base 631 to the shaft support 613.

The first supply channel 71 and the first discharge channel 81 are discrete channels which are isolated from each other by a partition 633. The base 631 and the cover 635 may be coupled to each other through thermal fusion so as to mitigate or prevent fluid present in the first supply channel 71 and the first discharge channel 81 from leaking to the outside of the first body 63.

The first supply channel 71 includes a first inlet 632 communicating with a first connecting pipe 73 which is opened and closed by the first valve V1, and a second inlet 634 communicating with a second connecting pipe 75 which is opened and closed by the second valve V2. Washing water having been introduced to the first supply channel 71 is discharged to the water supply pipe (the second supply channel) 77 through a first channel outlet 636.

As described above, the water supply channel includes the first supply channel 71 provided in the first body 63, the first and second connecting pipes 73 and 75 connected between the first supply channel 71 and the respective water supply sources and controlled to be opened and closed by the first and second valves V1 and V2, respectively, and the water supply pipe 77 connected between the first channel outlet 636 and the water supply opening 355 and supported by the second body 65.

Washing water supplied from the water supply sources is introduced into the first supply channel 71 through the first and second connecting pipes 73 and 75 which are opened and closed by the first and second valves V1 and V2, and the washing water in the first supply channel 71 is supplied to the water supply opening 355 formed at the drawer cover 35 through the first channel outlet and the water supply pipe 77. The water supply pipe 77 may be secured to the water supply opening 355 formed at the drawer cover 35 by means of a fixing portion 771.

The first discharge channel 81 is provided with a first discharge channel inlet 638 and a first discharge channel outlet 639. The first discharge channel inlet 638 and the first discharge part F4 are connected to each other through a first water discharge pipe 83, and the first discharge channel outlet 639 and the discharge pipe 615 are connected to each other through a second water discharge pipe 85.

Accordingly, the water discharge channel includes the first discharge channel 81 defined in the first body 63, the first water discharge pipe 83 connected between the first discharge channel 81 and the housing F1, and the second water discharge pipe 85 connected between the first discharge channel 81 and the discharge pipe 615.

The second body 65 constituting the guider 6 is rotatably connected to the first body 63 through a second shaft 651 and rotatably connected to the drawer cover 35 through a third shaft 653.

The second body 65 is provided with a first flange 656 and a second flange 657 which define a reception space 655 accommodating the water supply pipe 77.

The first flange 656 is longitudinally provided along the second body 65 and protrudes toward the upper surface of the cabinet 2 from a side surface of the second body 65. The second flange 657 is longitudinally provided along the second body 65 to face the first flange 656.

A water supply pipe attachment 659, which is detachably provided at the water supply pipe 77 to hold the water supply pipe 77 in the reception space 655, may be provided at at least one of the first flange 656 and the second flange 657.

Since the discharge pipe 615 provided at the support 61 includes a drainpipe F7 which is connected between the discharge pipe 615 and a sewage outlet to discharge washing water supplied through the water discharge channel, washing water in the tub body 41 may be discharged by the siphon effect upon activation of the motor F2.

When the siphon effect occurs, it may be advantageous if washing water does not remain in the tub body 41 or the water discharge channel. However, bad smell generated from the sewage outlet may be introduced into the tub body 41 through the drainpipe F7. Furthermore, when washing water is supplied to the tub body 41 before completion of discharge of washing water, there is a risk that even washing water introduced to the tub body 41 may be discharged.

Accordingly, the laundry treatment apparatus may further include a communication pipe 79 for preventing the siphon effect by the water discharge channel.

The communication pipe 79 may be configured in any shape so long as it can communicate the inside of the water discharge channel with the outside of the water discharge channel. In other words, the communication pipe 79 may be constructed to be connected between the water supply channel and the water discharge channel, and may be constructed to communicate the water supply channel with the inside of the drawer.

The communication pipe 79 may be constructed to connect one of the first discharge channel 81, the first water discharge pipe 83 and the second water discharge pipe 85 to the water supply pipe 77 or the water supply opening 355. The drawings illustrate an example in which the communication pipe 70 is connected between the water supply pipe 77 and the first discharge channel inlet 638 and is supported by the second body 65.

In order to support the communication pipe 79, the second flange 657 provided at the second body 65 may further include a communication pipe attachment 658 for detachably holding the communication pipe 79 outside the reception space 655.

In order to ensure that washing water supplied to the tub body 41 is not discharged to the outside of the tub body 41 through the water discharge channel even though the motor F2 provided at the discharge unit F is not operated, the discharge pipe 615 has to be positioned at a higher level than the maximum level of washing water contained in the tub body 41 (the first water discharge pipe 83 defining the water discharge channel is positioned below the guider 6 including the first discharge channel 81).

Under the above condition, when operation of the impeller is halted by deactivation of the motor F2 of the discharge unit F, air in the tub body 41 is introduced into the water discharge channel through the communication pipe 79, thus blocking the siphon effect. Consequently, washing water present at a position lower than the position at which the communication pipe 79 is connected to the first water discharge pipe 83 will remain in the first water discharge pipe 83.

When washing water remains in the first water discharge pipe 83, it is possible to introduction of foul odor generated from a sewage outlet into the tub body 41 but there is a risk of the first water discharge pipe 83 is rupturing upon freezing in winter. Accordingly, there is a need to discharge even washing water in the first water discharge pipe 83. To this end, in some examples the laundry treatment apparatus may include a residual water discharge unit 9.

As shown in FIG. 7, the residual water discharge unit 9 may include a residual water discharge tube 91 which communicates with the housing F1 of the discharge unit F and is exposed to the outside of the cabinet 2 when the drawer 3 is withdrawn from the cabinet 2.

A fixed end of the residual water discharge tube 91 may communicate with the housing F1 through the second discharge part F5, and a free end of the residual water discharge tube 91 may be detachably held on the drawer body 31. The free end of the residual water discharge tube 91 is provided with a water discharge pipe opening and closing device 911 for opening and closing the residual water discharge tube 91.

In order to hold the free end of the residual water discharge tube 91 on the drawer body 31, the residual water discharge unit 9 may further include a water discharge pipe attachment 93 provided at the drawer body 31.

The water discharge pipe attachment 93 is provided at the drawer body 31 such that it is positioned in the rear of the drawer panel 33 (near the open surface 21).

Specifically, the water discharge pipe attachment 93 may include a fixed body 931 fixed to the drawer body 31 to be positioned between the rear surface of the drawer panel 33 and the introduction opening 353, a fixed body through hole 933 formed through the fixed body 931, and an entrance 935 formed at the fixed body 931 such that the fixed body through hole 933 communicates with the outside of the fixed body 931.

The fixed body through hole 933 has a diameter equal to or larger than that of the residual water discharge tube 91, and the entrance 935 has a width smaller than the diameter of the residual water discharge tube 91.

As a result, a user can fit the residual water discharge tube 91 into the fixed body through hole 933 through the entrance 935, or can take the residual water discharge tube 91 out of the fixed body 931.

In order to prevent the residual water discharge tube 91 from becoming entangled in the cabinet or interfering with components provided in the cabinet 2 when the drawer 3 is withdrawn from the cabinet 2, the drawer body 31 may further include a water discharge tube support 313 for preventing the residual water discharge tube 91 from contacting the inner surface of the cabinet 2. FIG. 7 illustrates an example in which the water discharge tube support 313 is provided at a lower position of the drawer body 31.

In order to more efficiently discharge washing water remaining in the first water discharge pipe and the housing F1 through the residual water discharge tube 91, the first water discharge pipe 83 may be positioned such that a distance between the bottom surface of the drawer body 31 and the first water discharge pipe decreases toward the housing F1 of the water discharge unit F. In other words, the first water discharge pipe 83 may be downwardly inclined toward the housing F1 of the water discharge unit F.

The laundry treatment apparatus 100 may further include a water discharge pipe holder 95 adapted to hold the first water discharge pipe 83 at a location on the drawer body 31 higher than the first discharge port F4 of the housing F1 such that the first water discharge pipe 83 is partially inclined downwardly toward the first discharge part F4 of the housing F1.

The effects obtained by the inclined first water discharge pipe 83 may, of course, be obtained by inclining the first discharge part F4 of the housing F1 such that a distance between the bottom surface of the drawer body 31 and the first discharge part F4 increases in a direction away from the housing F1.

Figure 9A:
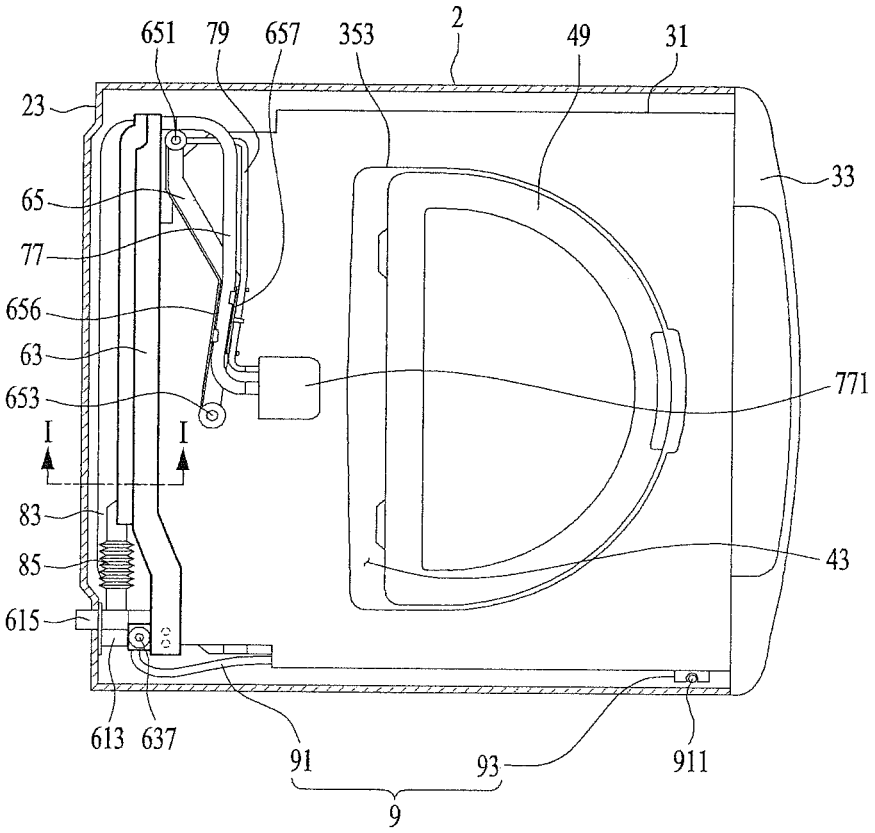
FIGS. 9A, 9B, and 10 are views showing examples of operations of a guider.
Figure 9B:
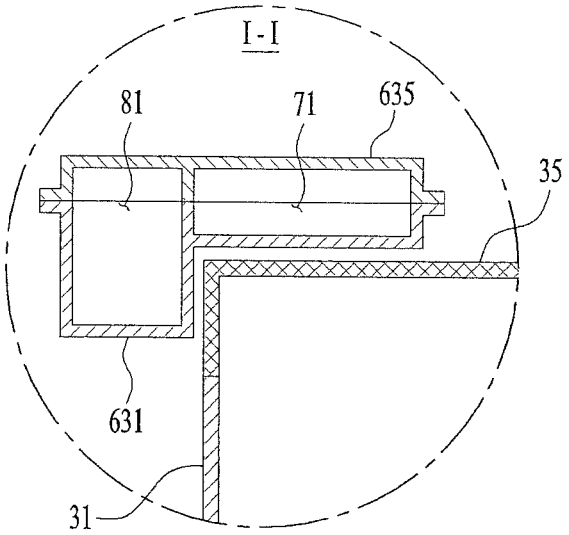

The first body 63 constituting the guider 6 may be configured to have a shape as shown in FIG. 8B, and may also be configured to have a shape as shown in FIGS. 9A and 9B. FIGS. 9A and 9B illustrate examples in which the first body 63 positioned at an upper portion of the rear surface of the drawer 3 has a cross-sectional shape capable of accommodating an upper edge of the rear surface of the drawer 3. In some examples, as a consequence of such configuration, the laundry treatment apparatus can increase or maximize a volume of the drawer 3 while reducing or minimizing a volume of the cabinet 2.

Specifically, the first supply channel 71 may be positioned at an upper portion of the drawer 3 to be parallel to the upper surface of the drawer 3 (e.g., the drawer cover 35), and the first discharge channel 81 may be positioned at a rear portion of the drawer 3 to be parallel to the rear surface of the drawer 3.

When the first body 63 sags due to gravity or external force (vibration of the drawer), since the area of the first body 63 at which the first supply channel 71 is provided may be supported by the upper surface of the drawer (e.g., the drawer cover 35), the cross-sectional shape of the first body 63 functions to mitigate or prevent deformation or breakage of the guider 6.

When the drawer 3 is fitted in the cabinet 2, the area of the first body 63 at which the first discharge channel 81 is provided functions to mitigate or prevent the first body 63 from being rotated toward the drawer 3. Accordingly, the above-described cross-sectional shape of the first body 63 functions to mitigate or prevent the first body 63 from escaping from the set position due to application of external force (vibration of the drawer).

Although not shown in the drawings, the laundry treatment apparatus may further include a hot air supply device (not shown) for supplying hot air to the tub 4 to dry laundry contained in the drum 5. The hot air supply device may be provided at any of the first treatment apparatus T and the second treatment apparatus L.

Hereinafter, operation of the laundry treatment apparatus will be described with reference to FIGS. 9A, 9B, and 10.

As shown in FIGS. 9A and 9B, the drawer 3 is positioned in the cabinet 2 before laundry is put into the second treatment apparatus L.

In order to put laundry into the accommodation unit 4-5 provided in the drawer 3, a user has to withdraw the drawer body 31 from the cabinet 2 using the drawer panel 33.

Figure 10:
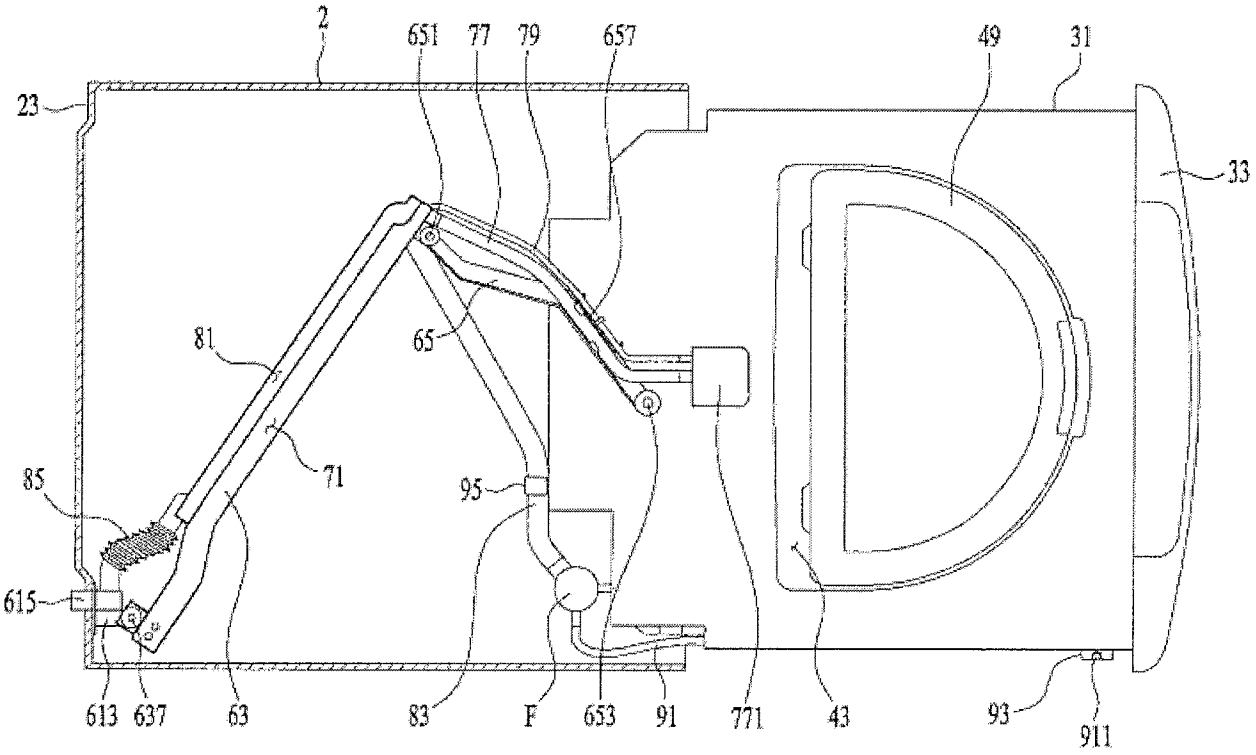

As shown in FIG. 10, when the drawer body 31 is withdrawn from the cabinet 2, the first body 63 is rotated in a drawing direction of the drawer body 31 about the first shaft 637 while the second body 65 maintains the state in which the first body 63 is connected to the drawer cover 35 through the second shaft 651 and the third shaft 653.

The first supply channel 71 constituting the water supply channel is provided at the first body 63, and the water supply pipe 77 connected between the first supply channel 71 and the water supply opening provided at the drawer cover 35 is supported by the second body 65. Therefore, the laundry treatment apparatus can mitigate or prevent the water supply channel from becoming entangled or caught by components provided in the cabinet 2 and thus broken.

In addition, since the first discharge channel 81 constituting the water discharge channel is provided at the first body 63 and the first water discharge pipe 83 connected between the first discharge channel 81 and the discharge unit F is positioned below the guider 6, it is also possible to mitigate or prevent the water discharge channel from becoming entangled or broken when the drawer 3 is withdrawn from the cabinet 2.

However, since the rotation center of the first body 63 and the rotation center of the second water discharge pipe 85 are different from each other as shown in FIG. 10, the second water discharge pipe 85 may be made of an elastic material (such as rubber) or may be constructed into a bellows structure capable of extending and contracting in a longitudinal direction.

When the drawer body 31 is withdrawn from the cabinet 2, the introduction opening 353 formed at the drawer cover 35 is exposed to the outside. As a result, a user can put laundry into the drum 5 positioned below the tub introduction port 435 by rotating the door 49 disposed in the introduction opening 353 to open the tub introduction port 435.

When laundry is put into the drum 5, a user closes the tub introduction port 435 by the door 49 and pushes the drawer 3 into the cabinet 2 as shown in FIGS. 9A and 9B.

At this point, since the first body 63 of the guider 6 is rotated in the same direction as the moving direction of the drawer 3 (counterclockwise direction) about the first shaft 637 and the second body 65 is rotated toward the first body 63 by the second shaft 651 and the third shaft 653, it is possible to possible to mitigate or prevent the water supply channel and the water discharge channel from breaking due to components provided in the cabinet 2, by virtue of the guider 6.

When a user inputs a control command for washing through the control panel 331 in the state in which the drawer 3 is disposed in the cabinet 2, the respective valves V1 and V2 provided at the supply unit S open one of connecting pipes 73 and 75 connected between the respective valves and the first supply channel 71.

Specifically, if only a first temperature washing water is required, a control unit (not shown) controls the first valve V1 to open only the first connecting pipe 73. In addition, if only a second temperature washing water is required, the control unit controls the second valve V2 to open only the second connecting pipe 75.

In any case, washing water from the water supply source is supplied to the first supply channel 71 provided at the first body 63, and the washing water supplied to the first supply channel 71 is supplied to the drum 5 through the water supply pipe 77 supported by the second body 65, the water supply opening 355 provided at the drawer cover 35 and the through hole 438 formed at the tub cover 43.

Upon completion of supply of the washing water, the driving unit rotates the drum 5. When the drum 5 rotates, washing water in the tub body 41 can rotate in the tub body 41, together with the drum.

When washing water is rotated in the tub body 41 by the drum 5, the washing water in the tub body 41 can move toward the tub cover 43 from the bottom surface of the tub body 41. However, since the tub cover 43 is provided with the inclined portion 4391, the laundry treatment apparatus can again introduce washing water into the drum 5 through the open upper surface of the drum 5.

Upon completion of washing, the control unit discharges washing water contained in the tub body 41.

More specifically, the control unit supplies power to the motor F2 provided at the discharge unit F to transfer washing water in the tub body 41 to the first water discharge pipe 83. The washing water introduced to the first water discharge pipe 83 flows to a sewage outlet through the first discharge channel 81 provided at the first body 63, the second water discharge pipe 85, the discharge pipe 615 and the drainpipe F7.

Since the first water discharge pipe 83 is connected to the water supply pipe 77 through the communication pipe 79 and the water supply pipe 77 communicates with the drawer body 31 through the water supply opening 355, when the control unit stops supply of power to the motor F2, air is supplied to the first water discharge pipe 83, thus reducing or eliminating a siphon effect. Consequently, the washing water that is flowing to the first discharge channel 81 through the first water discharge pipe 83 remains in the first water discharge pipe 83.

Furthermore, since the first water discharge pipe 83 is constructed to enable residual water in the first water discharge pipe 83 to be moved to the discharge unit F, almost all of the residual water in the first water discharge pipe 83 will be contained in the housing F1 of the discharge unit F.

If washing water is contained in the housing F1, it is possible to mitigate or prevent introduction of foul odor generated from a sewage outlet into the tub body 41 through the water discharge channel and to mitigate or prevent breakage of the first water discharge pipe 83 in the case of decrease in outside temperature of the laundry treatment apparatus.

Furthermore, since the residual water discharge tube 91 is connected to the housing F1, in some examples even residual water in the housing F1 may be discharged. However, in order to discharge residual water in the housing F1, a user has to withdraw the drawer 3 from the cabinet 2.

As shown in FIG. 10, since the free end of the residual water discharge tube 91 is exposed to the outside of the cabinet 2 when the drawer 3 is withdrawn from the cabinet 2, a user can discharge residual water in the housing F1 by separating the residual water discharge tube 91 from the water discharge pipe attachment 93 and then opening the water discharge pipe opening and closing device 911.

Furthermore, when washing water supplied for laundry washing is hot water or steam is supplied to laundry after washing of laundry, moisture (vapor or steam of hot water) supplied into the tub body 41 can be discharged to the outside of the tub body 41 through the through hole 438.

The moisture, which has been discharged to the outside of the tub body 41 through the through hole 438, is condensed on a surface of the first recovery part 451 provided over the through hole 438 and then falls to the second recovery part 453. Therefore, the laundry treatment apparatus can reduce or minimize that leakage of moisture in the tub body 41 into the drawer 3 or the cabinet 2.

Although the laundry treatment apparatus has been described in connection with the above example in which the first supply channel 71 constituting the water supply channel and the first discharge channel 81 constituting the water discharge channel are provided in the first body 63 of the guider, structures of the water supply channel and the water discharge channel are not limited thereto. In other words, the water discharge channel may be supported by the outer surface of the guider while the first supply channel 71 maintains the same construction as described above.

Here, the water discharge channel may be constituted by a single pipe connected between the housing F1 of the discharge unit F and the discharge pipe 615, and may be detachably held on the outer surface of the first body 63.

The first supply channel 71 of the water supply channel may be configured to have the same structure as described above, and the water supply pipe (second supply channel) 77 may be embodied as a channel (not shown) that is provided in the second body so as to guide washing water supplied from the first channel to the accommodation unit. In this case, the second body may be configured into a bar having an internal channel differently from the structure shown in the drawings.

The water supply channel may be constructed in such a manner that a single hose is supported by the first body 63 and the second body 65. In this case, the first supply channel 71 may be embodied as a hose that is detachably coupled to the first body 63, and the water supply pipe 77 may be embodied as a hose that is detachably supported by the second body 65, and may be connected to the first supply channel 71.

Although the laundry treatment apparatus has been described in connection with examples in which the second treatment apparatus L is detachably mounted on the first treatment apparatus T (the cabinet 1 of the first treatment apparatus and the cabinet 2 of the second treatment apparatus are separated from each other), the second treatment apparatus may be integrally formed with the first treatment apparatus T.

In this case, the drawer 3 constituting the second treatment apparatus L has to be constructed to be retractable from the cabinet of the first treatment apparatus (the cabinet 2 of the second treatment apparatus is omitted), and components of the second treatment apparatus L, which are fixed to or rotatably coupled to the cabinet 2 of the second treatment apparatus, may be provided at the cabinet 1 of the first treatment apparatus.

As described above, the laundry treatment apparatus may be capable of performing both functions of washing and drying of laundry.

Furthermore, the laundry treatment apparatus may be constructed to enable washing water to be easily supplied to or discharged from an accommodation unit retractably provided at a cabinet to accommodate laundry.

In addition, the laundry treatment apparatus may be capable of condensing moisture discharged from the accommodation unit and returning the condensed water to the accommodation unit.

Furthermore, the laundry treatment apparatus may be capable of mitigating or preventing washing water from remaining in a discharge unit serving to discharge washing water contained in an accommodation unit.

In addition, the laundry treatment apparatus may include means for circulating washing water in an accommodation unit.

It will be apparent to those skilled in the art that various modifications and variations can be made without departing from the spirit or scope of the disclosure. Thus, it is intended that the present disclosure covers modifications and variations that come within the scope of the appended claims and their equivalents.

What is claimed is:

1. A laundry treatment apparatus comprising:

a cabinet;

a drawer configured to be extracted from and retracted into the cabinet;

an accommodation unit provided in the drawer to store water;

a guider comprising:

a first body having a first end that is rotatably coupled to the cabinet and a second end, the first body providing a first channel therein, and a second body having a first end that is rotatably coupled to the drawer and a second end that is pivotally coupled to the second end of the first body;

a connection pipe that is provided on a rear wall of the cabinet and that connects a water supply source to the first end of the first body; and a water supply pipe that connects the second end of the first body to the drawer and that is configured to provide fluid communication with the first channel of the first body such that water from the water supply source is supplied to the accommodation unit, through the connection pipe, the first channel of the first body, and the water supply pipe.

2. The laundry treatment apparatus according to claim 1, wherein the first body and the second body are configured to rotate in a plane parallel to a bottom surface of the cabinet while the drawer is extracted from or retracted into the cabinet.

3. The laundry treatment apparatus according to claim 1, wherein the first body and the second body are located in a space defined between an upper surface of the cabinet and an upper surface of the drawer.

4. The laundry treatment apparatus according to claim 1, wherein at least a part of the water supply pipe is supported by the second body.

5. The laundry treatment apparatus according to claim 1, wherein the second body comprises:

a first bar portion including the second end of the second body and rotatably coupled to the second end of the first body;

a second bar portion including the first end of the second body and rotatably coupled to the drawer; and a connecting bar portion that is connected to the first bar portion and the second bar portion and that is angled away from the first body based on the drawer being retracted into the cabinet.

6. The laundry treatment apparatus according to claim 5, wherein the second body is configured to detachably hold a portion of the water supply pipe.

7. The laundry treatment apparatus according to claim 5, wherein a distance between the first body and the second bar portion of the second body is longer than a distance between the first body and the first bar portion of the second body based on the drawer being retracted into the cabinet.

8. The laundry treatment apparatus according to claim 5, wherein the first bar portion and the second bar portion are parallel to the first body based on the drawer being retracted into the cabinet, and wherein the connecting bar portion is inclined with respect to the first body based on the drawer being retracted into the cabinet.

9. The laundry treatment apparatus according to claim 1, wherein the water supply pipe comprises:

a first end connected to the first channel of the first body;

a second end spaced apart from the first end of the second body and connected to an upper surface of the drawer; and a middle part supported by the second body.

10. The laundry treatment apparatus according to claim 1, wherein the first body provides a second channel therein, and wherein the laundry treatment apparatus further comprises:

a discharge unit configured to discharge washing water from the accommodation unit to an outside of the accommodation unit, a first water discharge pipe connected to the second end of the first body and the discharge unit and configured to provide fluid communication between the second channel of the first body and the accommodation unit, and a second water discharge pipe connected to the first end of the first body and a drainpipe positioned outside of the cabinet, and configured to provide fluid communication between the second channel of the first body and the drainpipe.

11. The laundry treatment apparatus according to claim 10, wherein the second channel is provided alongside the first channel, and wherein the first channel and the second channel are divided by a partition provided inside the first body.

12. The laundry treatment apparatus according to claim 11, wherein the first water discharge pipe extends along a rear surface of the drawer and is connected to the second end of the first body.

13. The laundry treatment apparatus according to claim 12, wherein the second water discharge pipe comprises a bellows hose, wherein a first end of the second channel is connected to the bellows hose of the second water discharge pipe, and wherein the second water discharge pipe is connected to the drainpipe at a predetermined distance away from a rotation shaft in which the first body is rotatably connected to the cabinet.

14. The laundry treatment apparatus according to claim 10, wherein a length of a first part of the first body forming the first channel is longer than a length of a second part of the first body forming the second channel.

15. The laundry treatment apparatus according to claim 14, wherein the second water discharge pipe comprises a bellows hose, wherein the bellows hose disposed between a first end of the second part of the first body forming the second channel and a rotation shaft by which the first body is rotatably connected to the cabinet.

16. The laundry treatment apparatus according to claim 14, wherein the first part of the first body extends from a first end of the second part of the first body and is connected to a rotation shaft by which the first body is rotatably connected to the cabinet.

* * * * *